US007435894B2

(12) United States Patent
Veno

(10) Patent No.: US 7,435,894 B2
(45) Date of Patent: Oct. 14, 2008

(54) MUSICAL BALL

(76) Inventor: Ann Elizabeth Veno, 1431 Elm St., El Cerrito, CA (US) 94530

( * ) Notice: Subject to any disclaimer, the term of this patent is extended or adjusted under 35 U.S.C. 154(b) by 0 days.

(21) Appl. No.: 11/724,096

(22) Filed: Mar. 14, 2007

(65) Prior Publication Data

US 2007/0214939 A1 Sep. 20, 2007

Related U.S. Application Data

(60) Provisional application No. 60/783,288, filed on Mar. 16, 2006.

(51) Int. Cl.
*G10H 1/00* (2006.01)

(52) U.S. Cl. ..... 84/615; 84/653

(58) Field of Classification Search ..... 84/600, 84/609–610, 615, 622, 645, 649, 650, 653, 84/659, 723, 735, 742
See application file for complete search history.

(56) References Cited

U.S. PATENT DOCUMENTS

| | | | | |
|---|---|---|---|---|
| 4,662,260 | A * | 5/1987 | Rumsey | 84/653 |
| 4,801,141 | A * | 1/1989 | Rumsey | 84/639 |
| 5,260,512 | A * | 11/1993 | Chomette et al. | 84/644 |
| 6,969,795 | B2 * | 11/2005 | Hofmeister et al. | 84/600 |
| 7,012,182 | B2 * | 3/2006 | Nishitani et al. | 84/609 |
| 7,230,178 | B2 * | 6/2007 | Ishida et al. | 84/615 |
| 7,294,777 | B2 * | 11/2007 | Hofmeister et al. | 84/615 |
| 2002/0088335 | A1 * | 7/2002 | Nishitani et al. | 84/600 |
| 2002/0134223 | A1 * | 9/2002 | Wesley | 84/719 |
| 2002/0166439 | A1 * | 11/2002 | Nishitani et al. | 84/600 |
| 2003/0230186 | A1 * | 12/2003 | Ishida et al. | 84/737 |
| 2004/0000225 | A1 * | 1/2004 | Nishitani et al. | 84/610 |
| 2005/0098021 | A1 * | 5/2005 | Hofmeister et al. | 84/453 |
| 2006/0144212 | A1 * | 7/2006 | Hofmeister et al. | 84/724 |

* cited by examiner

*Primary Examiner*—David S. Warren

(57) ABSTRACT

An apparatus for the production of sound includes a a ball that includes an impact sensor that is activated by a deceleration such as impact of the ball upon a floor and upon activation of the impact sensor, an output signal is transmitted to a receiver and wherein the output signal includes information the impact such as the timing and rate of deceleration, and wherein the receiver acts as both a radio frequency receiver and also as a musical synthesizer that is programmable to respond to the first radio frequency signal to produce an amplified first synthesized sound that is output through a speaker that is either attached to the receiver or locate remotely with respect thereto, and wherein the process can include multiple balls producing multiple simultaneous sounds to replicate an orchestra or composite performance when more than one person is bouncing a ball on the floor.

There is also an acoustic or acoustic electronic version of the ball described.

4 Claims, 2 Drawing Sheets

MUSICAL BALL

The applicant claims the Priority of Benefit of Provisional Patent Application Ser. No. 60/783,288 that was filed on Mar. 16, 2006 by the same inventor and which is entitled, "Musical Bouncing Balls".

BACKGROUND OF THE INVENTION

1. Field of the Invention

The present invention, in general, relates to sound production and, more particularly, to musical instruments.

People enjoy playing music. That is why musical instruments exist. However, there is a need for one or more people, not well familiar with music theory or skilled in the art of playing a particular musical instrument to be able to play.

I thought of this idea on January 1999 when I was a Public school music teacher and was teaching music to very active elementary-school children. I've always had a particular interest in and focus on improvisation and this idea was sparked by these (said) conditions.

The object is a music-making object. It is a musical bouncing ball (developed as a series of music bouncing balls) that sound (use of the verb form of sound often used in language describing instruments) on impact with a musical note or other sound, useful for improvising, composing, and performing by a group or individual in a hands on or physical way. Idea conceived January 1999.

The present invention is a new music-making (group of objects) object—a series of balls—or instrument, which make sound (musical note or other sound(s)) upon impact. It provides a hands-on, gross-motor skill, way to create or perform music in a group—or by oneself using multiple bouncing balls.

A group of individuals could play, for example, a chord if three students (or more) each had a separate ball, each ball sounding the musical note in a chord. Individuals could play the chord as an ostinato, each bouncing the ball separately or play the balls all at once, to sound a block chord.

Another group or individual—manipulating multiple balls—could provide a corresponding melody by bouncing balls from a series of balls with varying notes and sounds. The rhythm could be established by the facility of the person or persons, bouncing the ball. The sound from the ball could also be controlled to sustain for varying lengths of time (or be otherwise altered.)

It can be appreciated that many music-making objects, or instruments, often require fine motor skills and much study before successful improvising, composing, or performing can occur. The musical bouncing balls could be used by non-, beginning and advanced musicians alike, as well as children who cannot yet master the necessary skills or any individual much challenged by the technicality required for playing instruments. It can be appreciated that for many instruments this process can take years, and for some ease still never comes. This music-making object would be an effective way to free up said individuals or individual to focus on the creativity and joy of the sound and movement, that which is being created or performed. For beginning musicians, one could also limit the notes to be those of the pentatonic scale thereby ensuring that whatever music was created would sound good. This sets up said individuals or individual for success. This may offer creative experiences to those who might not otherwise have access to that process at least in this specific way. This could be useful to special-needs students, the elderly, accomplished musicians and many other individuals.

Also a set of musical bouncing balls could easily be incorporated into dance and theatre.

The balls could be made or programmed to sound in any scales or with any sounds that an individual would choose to have them sound. In this respect creating and/or playing music according to the present invention substantially departs from the prior art of other object's—that create music—concepts and designs.

Accordingly, there exists today a need for a musical ball that helps to ameliorate the above-mentioned problems and difficulties as well as ameliorate those additional problems and difficulties as may be recited in the "OBJECTS AND SUMMARY OF THE INVENTION" or discussed elsewhere in the specification.

Clearly, such an apparatus would be a useful and desirable device.

2. Description of Prior Art

Musical instruments are, in general, known. While the structural arrangements of the previously known devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a musical ball that is easy to use.

It is also an important object of the invention to provide a musical ball that can be used by a person to produce music.

Another object of the invention is to provide a musical ball that can be used simultaneously by a plurality of people to produce a composite sound.

Another object of the invention is to provide a musical ball that is useful in group-musical improvisation, music education (regular and special education) and (can be provided usefully) as an adjunct or enhancement to dance or theatre.

Another object of the invention is to provide a musical ball, a musical bouncing ball, that generates or triggers sound upon impact, whether acoustically or electronically, a ball of varying size that produces a musical note or a sound on impact.

Another object of the invention is to provide a musical ball that sounds on bouncing impact and provides an improvisational or performance-focused musical experience to a group of people or an individual that is markedly hands-on and physical.

Another object of the invention is to provide a musical ball is to provide a ball that create sound (notes, etc.) on impact on any surface (possibly, in some cases, if wanted, to the hand.) The ball could also generate other sounds based on its other movements such as a sound corresponding to the ball gliding.

Another object of the invention is to provide a musical ball, an electronic version which could utilize a sensor or other wireless devise is used to either generate sound, trigger sound from an outside sound source, amplify the electronic sound from inside the ball and/or transfer the sound from inside the ball to an outside source.

Another object of the invention is to provide an An acoustic version of the bouncing music balls, that would use a bell, toned metal (or wood or other material), straight or coiled tube or string and mallet (internally) of various shapes, inside the ball that creates the sound (either by being struck or set off) upon impact and a damper around the bell, which mechanically responds to the impact and also can respond to other settings, and can control the duration of the sound that is produced upon impact (in various ways). The sound can be limited by impact or extended. Both the damper and the settings can mechanically alter and/or manipulate the quality of the sound.

Another object of the present invention is to provide an acoustic version of the musical balls that utilizes dampers which can be electronic, mechanical or wireless or settings on the ball (for example a switch) which can be electronic, mechanical, or wireless, the outcome being an acoustic-electronic object. In the combo version the sound source can come from inside or outside the ball, utilizing transistors, or midi from midi or other sound sources, inside from the bell or acoustic feature (s) chosen, all of which could be altered electronically or mechanically. Also use of sensors and wireless devices, transistors, effects, etc., to assist in development or quality of noise or sound. Various combinations can be used.

Another object of the invention is to provide a musical ball, which would or could be a combination of acoustic/electronic which could use a bell (inside the ball) (could also possibly be on surface of ball as can other sound producing materials) that is triggered to be struck on impact through embedded sensors or mechanical devises. Or a tube inside the ball wherein air is forced out on impact or a string is struck on impact could use sensors and wireless devices, even transistors, etc. to assist in the impetus of the mechanics and/or assist in the development or alteration of the quality of the noise or sound.

Another object of the invention is to provide an electronic version; some of the acoustic features may be used as well for a combo electronic-acoustic model, or an acoustic version with electronic features.

A primary object of the present invention is to provide a musical ball that if the duration of the note is not altered then the individual's (or Group's) facility with bouncing balls in general could more easily form the rhythm but electronically one could add on a delay or other sound-manipulating features connected to the impact (affecting sound, quality of sound, duration of sound, rhythm).

Another object of the music-making object (series of objects) is to provide a music or sound-producing music-bouncing ball that has an electronic device that produces sound inside the ball.

Another object of the music-making object (series of objects) is to provide a music or sound-producing music bouncing ball that has an electronic device inside the ball that can trigger a musical note from another sound source-midi, etc.

Another object of the music-making object (series of objects) is to provide a music or sound-producing music-bouncing ball that can generate acoustically or electronically a sound or musical note whose duration can be limited by impact.

Another object of the music-making object (series of objects) is to provide a music or sound-producing music bouncing ball that can generate acoustically or electronically a sound or musical note whose duration can be extended, sustained, or altered from an outside sound source, or otherwise manipulated. Examples of alterations would be sampling sounds voices etc., delays, changing the sound or pitch, encompassing an ability to adapt to manipulations of sound that are generally used.

Still yet another object of the invention is to provide a combo acoustic electronic ball which has inside it a string which is struck on impact. Sensors and/or wireless devices, even transistors, etc., could be used to assist in development or quality of noise or sound.

Another object of the music-making object (series of objects) is to provide a music or sound-producing music bouncing ball that has an electronic device inside the ball that can trigger a musical note from another sound source-midi etc.

Another object of the music-making object (series of objects) is to provide a music or sound-producing music bouncing ball that can generate acoustically or electronically a sound or musical note whose duration can be extended, sustained or altered from settings inside the ball, mechanical and/or electronic.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

Briefly, a musical ball that is constructed in accordance with the principles of the present invention has a ball that includes an impact sensor. The impact sensor is activated by a deceleration that is experienced by the ball when it impacts a surface, such as a floor. Upon activation of the impact sensor, an output signal is transmitted, for example by a unique first radio frequency signal, to a receiver. The output signal includes information about timing, that is when the impact on the floor occurred, and the rate of deceleration, which is indicative of the force of impact. The receiver acts as both a radio frequency receiver and also as a musical synthesizer. The receiver is programmable to respond to the first radio frequency signal to produce an amplified first synthesized sound that is output through a speaker that is either attached to the receiver or locate remotely with respect thereto. An additional second ball can be used with a corresponding unique second radio frequency signal, and so on. The receiver is programmed to respond to each unique radio frequency signal received to produce a synthesized sound of a corresponding and preferably different musical instrument. Accordingly, when a single person is bouncing a ball a single instrument is heard and when a group of people are bouncing a plurality of the balls, an orchestral musical rendition is provided.

DETAILED DESCRIPTION OF THE INVENTION

Figure 1:
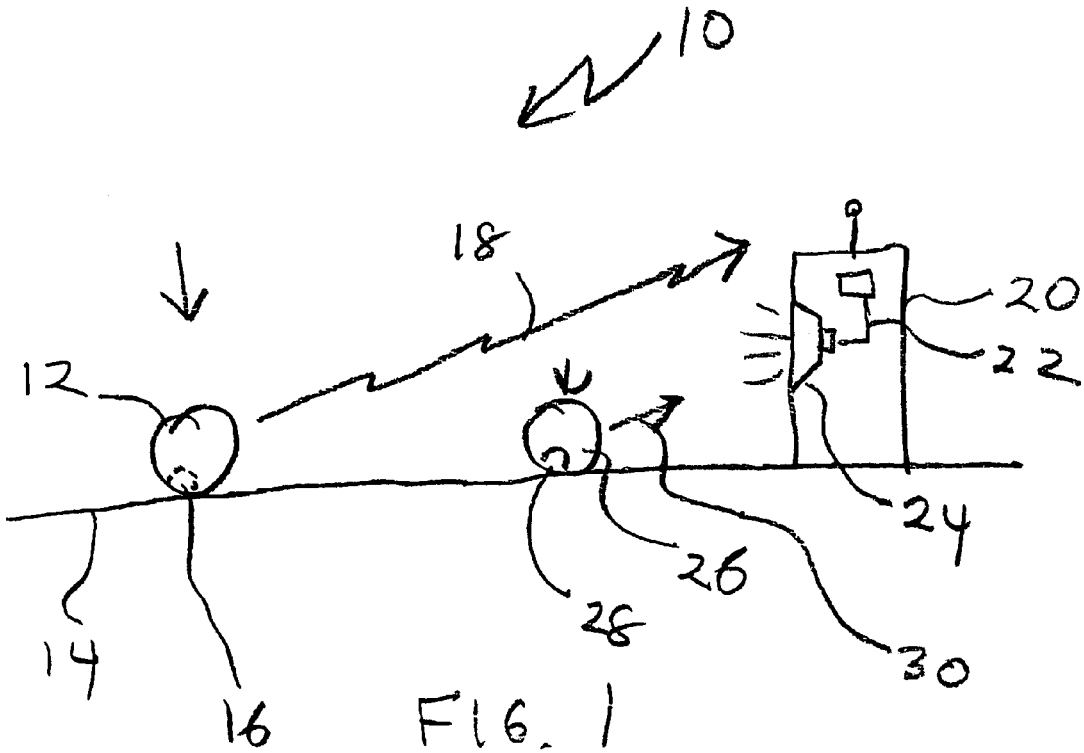
FIG. 1 is a block diagrammatic view of a musical ball system.

Referring to FIG. 1 is shown, a musical ball system, identified in general by the reference numeral 10.

The system 10 includes a ball 12 that is shown being bounced on a floor 14. A sensor 16 in the ball (dashed lines) detects deceleration by the ball 12 and when the rate of deceleration exceeds a predetermined threshold, the ball 12 includes means to produce an output signal 18, such as an RF signal. The output signal 18 is produced and transmitted to a nearby receiver 20. The receiver 20 responds to the output signal 18, which is unique for the ball 12, and produces a first audio output signal 22 that is amplified and outputted through a speaker 24.

The receiver 20 is programmable to produce any desired or preferred type of sound for the first audio output signal 22, for example to replicate the sound of a drum, wind instrument, percussion instrument, etc.

A second ball 26 includes a second sensor 28 and produces a second output signal 30 that the receiver 20 similarly detects and responds to the second output signal 30. Preferably, the receiver is programmed to produce a second audio output signal that is different than the first audio output signal 22, thereby replicating the sound simultaneously to two instruments.

Additional balls (not shown) can be added to produce any desired live band or orchestral sound production or the musical ball system 10 can be used by only one person at a time.

The system 10 includes a ball 12 that is shown being bounced on a floor 14. A sensor 16 in the ball (dashed lines) detects deceleration by the ball 12 and when the rate of deceleration exceeds a predetermined threshold, the ball 12

Figure 2:
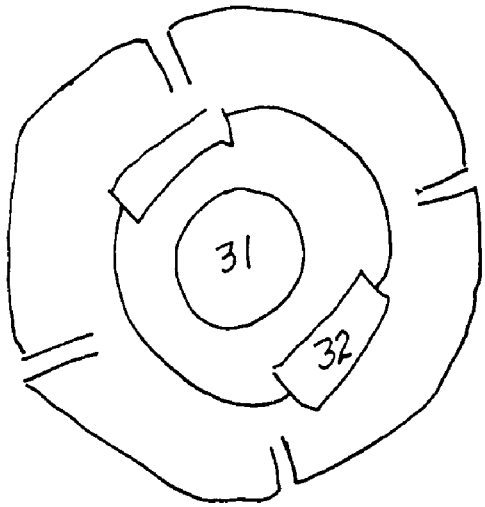
FIG. 2 is an alternate or modified musical ball, which would be played alone or in a series.

Referring to FIG. 2 is shown, a musical ball that in this case is made of rubber (other materials can be used) and holds inside it 31, a bell and 32, a damper (in this case made of rubber but other materials can be used) and with constructed holes for escape of sound. Tubes and air cavities inside the ball could amplify sound or an electronic or wireless amplification device can be inserted. This ball could be used alone or in a series.

Figure 3:
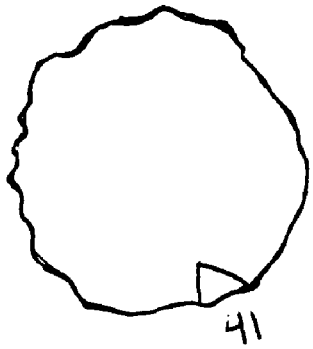
FIG. 3 is an alternate or modified musical ball system

Referring to FIG. 3, is shown a ball with 41, a sensor or sensors embedded in the material of which the ball is made. The covering of the ball is bumpy to accommodate a sensor or sensors (but smooth would work). This ball could be used alone or in a series.

Figure 4:
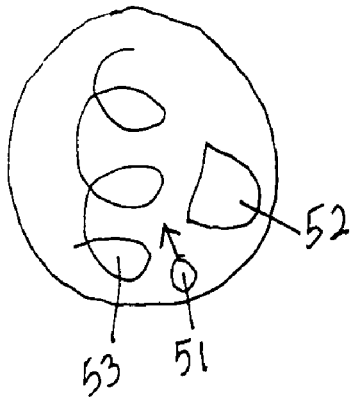
FIG. 4 is an alternate or modified musical ball system

Referring to FIG. 4, is shown a ball that includes 51, a trigger which goes off on impact and activates 52. an air pump or other device to set off air escaping through 53, a metal tube—tuned by length, width and material to specify a musical note. This may also have a setting, which can alter the note by for example shortening the metal tube via a mechanical means. This ball could be used alone or in a series.

I am describing a music-bouncing ball, a round ball of varying size that sounds a musical note or sound. The ball sounds on impact. In the acoustic version the bell inside the ball creates the sound. It is struck either directly from impact or with a striking device that functions on impact. This sound can, but doesn't have to, be manipulated by a damper and/or other settings.

Other sound sources could be used acoustically inside the ball as well. A string or coiled tube with air set to go through it could be hit or triggered and dampened and controlled in other ways with a damper. Also various shapes of toned metal or wood inside the ball. Any combination of these features could be used.

There is a damper around the bell that is triggered as well by impact that stops the sound (as one of it's functions) thereby limiting sound to impact of ball to surface—it can also dampen the sound, stop the sound, sustain the sound. It affects sound duration and quality in varying ways.

In the electronic version there is a wireless or electronic device inside the ball, which causes the sound.

In the electronic version there is a wireless device or sensor that transfers the sound from a sound source outside the ball.

A wireless device could also amplify the sound from the acoustic or electronic version and transfer sound to an outside source or just outside the ball. There are also settings on the ball that are mechanical or electronic that can alter and control the sound as has been previously specified.

All combos of said electronic and acoustic features can be combined or used separately.

A music-making bouncing ball of varying size that sounds on impact with a surface.

In the acoustic version of the musical bouncing ball a bell (or other device) inside is sounded on impact.

The damper controls the sound in various ways, stopping sound, extending duration, changing sound, pitch, etc.

Other mechanical settings can further manipulate the sound.

Other sound sources could be used acoustically inside the ball as well. A string or tube or coiled tube with air set to go through it could be hit or triggered and dampened and controlled in other ways with a damper.

In the electronic version of the musical bouncing ball:

A sensor in the ball can trigger sound from inside or a sound source outside the ball.

A wireless device can trigger sound from inside or a sound source outside the ball.

Electronic settings can further manipulate the sound

In an acoustic-electronic combo musical bouncing ball:

Electronic amplification could amplify the sound from outside the ball or to a sound source.

Wireless devices could manipulate and transfer the acoustic sound to be blended, altered, or enhanced, etc. with, either or both an outside sound source and or the acoustic sound.

And said invention would include all combinations and variances in between of electronic and acoustic features as pertains to the musical bouncing balls.

A combo acoustic electric ball could use a bell that is triggered to be struck on impact through embedded sensors or mechanical devises. Or a tube inside the ball where air is forced out on impact or a string is struck on impact could use sensors and wireless devices, even transistors, etc. to assist in development or quality of noise or sound.

The outside and inside of the ball could be made of different materials. Beach type (air-plastic) ball with imbedded sacs and sensors could be used. Rubber with areas to put embedded components could be used. Spongy material, leather, cloth-type stuffing, spongy foam type material, soft and hard plastics, layers of wood and/or metal can be used. Any suitable materials, and combinations thereof, that are used in making things bounce can be used.

The surface could be smooth or bumpy depending on the need for sensors and contained around areas that let the sound out—amplification source or sound outlet (when not using a sensor.)

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A music system comprising:

(a) a plurality of musical balls each assigned a single predetermined specific note wherein each ball includes a sensor therein that is adapted to detect deceleration and to produce an output signal indicative of said predetermined specific note in response to said deceleration when said deceleration exceeds a predetermined threshold, and including means to transmit said output signal to a location that is remote with respect to said ball; and (b) a receiver adapted to receive said output signal from each of said plurality of musical balls and to produce each of said predetermined specific notes as audio output signals in response thereto that replicates the sound of a musical instrument;

(c) wherein at least two of said plurality of musical balls have different assigned predetermined specific notes or sounds; and (d) wherein said predetermined threshold is selected so that said output signals are produced on impact with a surface or object.

2. The music system of claim 1 wherein said receiver is adapted to produce said audio output signals from each of said plurality of musical balls simultaneously.

3. The music system of claim 1 wherein sound-manipulating features connected to the impact may be added to the predetermined specific note.

4. The music system of claim 1 wherein the plurality of musical balls are provided with an electronic device inside the balls that can trigger a musical note from another sound source using MIDI.

* * * * *